United States Patent [19]

Elliot et al.

[11] Patent Number: 4,755,152

[45] Date of Patent: Jul. 5, 1988

[54] END SEALING SYSTEM FOR AN ELECTRICAL CONNECTION

[75] Inventors: Thomas G. Elliot; Hal E. Brink, both of Littleton, Colo.

[73] Assignee: Tele-Communications, Inc., Denver, Colo.

[21] Appl. No.: 930,446

[22] Filed: Nov. 14, 1986

[51] Int. Cl.[4] ..... H01R 13/58

[52] U.S. Cl. ..... 439/452; 439/276; 439/275; 439/585; 174/75 C

[58] Field of Search ..... 339/94, 60, 177 R, 177 E, 339/218, 275, 97 R, 97 P, 99 R, 276 R, 136, 126 RS; 174/89, 75 C; 29/854–858

[56] References Cited

U.S. PATENT DOCUMENTS

| | | | |
|---|---|---|---|
| 3,358,264 | 12/1967 | Brejcha, Jr. | 339/177 R |
| 3,492,408 | 1/1970 | Forney, Jr. et al. | 174/75 C |
| 3,550,064 | 12/1970 | Caller et al. | 339/94 C |
| 4,540,231 | 9/1985 | Forney, Jr. | 339/94 C |

*Primary Examiner*—Gil Weidenfeld
*Assistant Examiner*—David Pirlot
*Attorney, Agent, or Firm*—Klaas & Law

[57] ABSTRACT

A system for protecting exposed portions of an electric cable mounted in an electrical connector from detrimental components, such as liquids and gases, by inserting a movable sealing material into a cavity in the electrical connector and displacing the movable sealing material during the insertion of the electrical cable into the electrical connector so as to form an effective seal between the outer surface of the electrical cable and the inner surface of the electrical connector to prevent any detrimental components from entering into the electrical connector and attaching a continuous glob of movable sealing material to close an opening in the electrical connector so that, when an electrical cable is mounted in the electrical connector with the bared end portion passing through the glob of movable sealing material, exposed portions of the electrical cable will be protected by the movable sealing material.

10 Claims, 1 Drawing Sheet

Fig. 1.
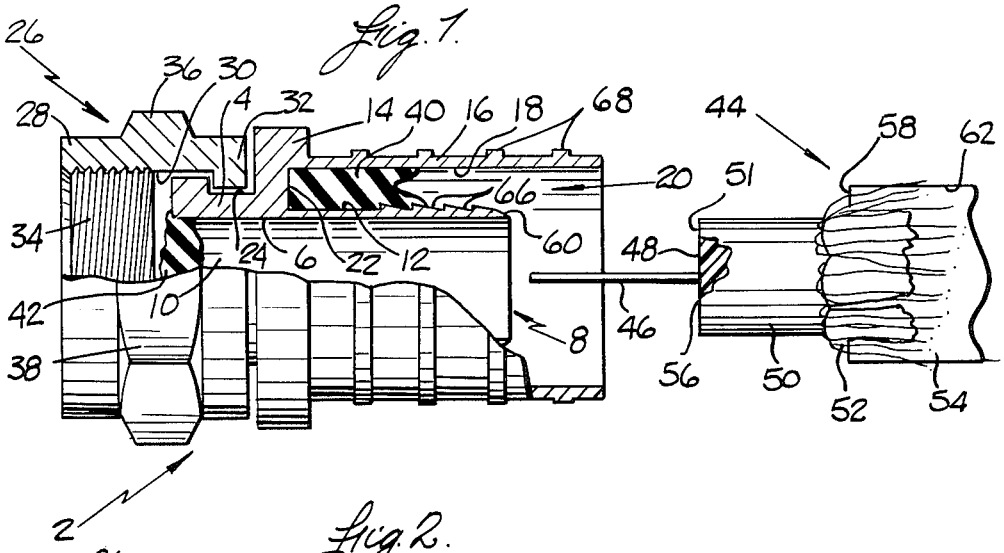
Fig. 2.
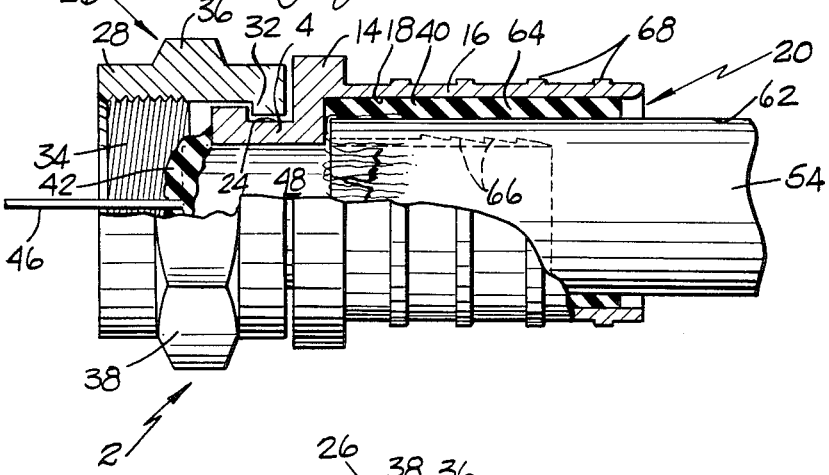
Fig. 3.
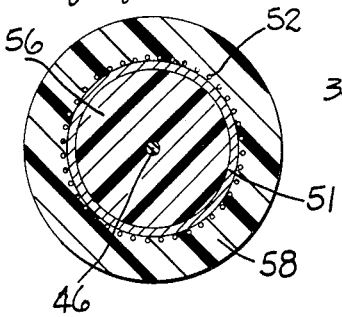
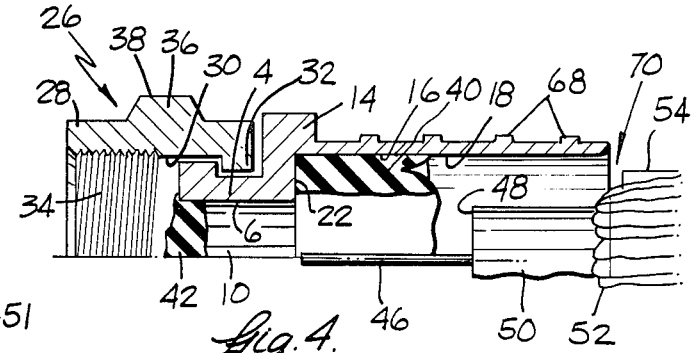
Fig. 4.

END SEALING SYSTEM FOR AN ELECTRICAL CONNECTION

FIELD OF THE INVENTION

This invention relates generally to electrical connecting systems and more specifically to a system for providing an end seal for protecting exposed surfaces of an electrical cable mounted in an electrical connector, such as a F-fitting connector, and to prevent detrimental components from entering either the electrical cable or the electrical connector.

BACKGROUND OF THE INVENTION

There are many different types of electrical cable wherein a center conductor is surrounded by one or more layers of different kinds of material. When the electrical cable is to be attached to an electrical connector, a portion of the center connector is bared by removing a portion of the one or more layers. One method for making an electrical connection involves the utilization of a F-fitting connector and an electrical cable having a center conductor, a first layer comprising a dielectric, a second layer comprising an electrically conducting sheath, a third layer comprising a braid and a fourth layer comprising a jacket, such as a polyethylene jacket. In using an F-fitting connector, the end portion of an electrical cable is bared by stripping away the first, second, third and fourth layers surrounding the inner electrically conducting center conductor. A portion of the fourth layer is removed and the exposed braid of the third layer is folded back over the fourth layer to expose the second layer and the end portion of the first layer. The end portion of the electrical cable is then inserted into an F-fitting connector which has a first hollow annular member that moves between the second and third layers of the cable. The third and fourth layers move over the hollow annular member into an annular space surrounding the hollow annular member and formed by a second hollow annular member spaced from the first hollow annular member until the end of the fourth layer covered by the braid abuts against a wall between the first and second hollow annular members. The center conductor, the first and second layers pass through the first hollow annular member and the center conductor projects outwardly from an end wall thereof. A threaded connecting means surrounds the bared center conductor and is used to connect the F-fitting to another electrical connector. The second hollow annular member is then crimped to lock the electrical cable in place in the F-fitting connector. In such a fitting, the end portions of the first layer, a portion of the second layer, a portion of the third layer and the end portion of the fourth layer are exposed so that they may be contacted by detrimental components.

BRIEF DESCRIPTION OF THE INVENTION

This invention provides a seal for the exposed portions of the one or more layers of an electrical cable after portions thereof have been removed to provide a center conductor having a bared end portion and which is then mounted in an electrical connector so as to protect the exposed portions of the one or more layers from detrimental components, such as liquids or gases.

In one embodiment of the invention, a movable sealing material is inserted into the hollow annular space between the first and second hollow annular members of an F-fitting connector of the type described above. The hollow annular space has an open end and a closed end. The movable sealing material is distributed evenly in the hollow annular space close to the closed end of the hollow annular space. An electrical cable having the end portion prepared as above is inserted into one end opening of a first hollow annular member and is pushed into the F-fitting connector. As described above, the center conductor and the first and second layers of the electrical cable move through the inner portion of the first hollow annular member of the F-fitting connector while the third and fourth layers of the electrical cable move over the outer surface of the first hollow annular member and into the hollow annular space. The movement of the electrical cable is continued and the end portion of the third and fourth layers of the electrical cable move into contact with the evenly distributed movable sealing material. Continued movement of the third and fourth layers of the electric cable forces the movable sealing material against the closed end of the hollow annular space and then back over the outer surface of the fourth layer of the electrical cable. Sufficient sealing material is initially inserted into the hollow annular space to ensure that at least a longitudinally extending portion of the annular space between the outer surface of the fourth layer of the electrical cable and the inner surface of the second hollow annular member is completely filled with the movable sealing material to form a continuous seal to protect the exposed end portions of the third and fourth layers.

In a further embodiment of the invention, a glob of the movable sealing material is attached to the wall portion of the first hollow annular member at the other end of the first hollow annular member around a central opening formed therein so as to close the central opening. During the continued movement of the electrical cable, the bared end portion of the center conductor moves through the glob of movable sealing material while the end of the first layer and sheath move into contact with the glob of movable sealing material so as to form a continuous seal between portions of the bared end portion and the portions of the end wall defining the central opening to protect the exposed annular end portion of the first layer and the exposed portion of the second layer.

It is an object of this invention to provide sealing means to protect the exposed end portions of an electrical cable secured in an electrical fitting from detrimental components.

Additional objects, advantages, and novel features of the invention are set forth in part in the description which follows which will be understood by those skilled in the art upon examination of the following or may be learned by practice of the invention. The objects and advantages of the invention may be realized and obtained by means of the instrumentalities and combinations particularly pointed out in the appended claims.

BRIEF DESCRIPTION OF THE DRAWING

FIG. 1 is a side elevational view with parts in section of the various components for an electrical fitting connection;

FIG. 2 is a side elevational view with parts in section of the components of FIG. 1 in an assembled relationship;

FIG. 3 is a cross-sectional view of an electrical cable; and

FIG. 4 is a side elevational view with parts in section of another embodiment of the invention.

DETAILED DESCRIPTION OF THE INVENTION

In the drawing, there is illustrated an F-fitting connector 2 having a first hollow annular member 4 having a generally cylindrical inner surface 6 and end openings 8 and 10 and a generally cylindrical outer surface 12 extending for a portion of the axial length of the first hollow annular member. A annular flange portion 14 projects outwardly in a radial direction from the first hollow annular member 4. A second hollow annular member 16 projects axially from the annular flange portion 14 and is concentric to said first hollow annular member 4. The second hollow annular member 16 has an inner surface 18 spaced from the generally cylindrical outer surface 12 so as to provide a hollow annular space 20 therebetween. The hollow annular space 20 is closed at one end by a portion 22 of the flange portion 14. An inwardly directed annular recess 24 is formed in the first hollow annular member 4. A rotatable fastening means 26 is provided and comprises a ring shaped body 28 having a generally cylindrical inner surface 30 with a radially inwardly extending flange 32 which is located in the annular recess 24. The inwardly directed flange 32 and the annular recess 24 are dimensioned so that the fastening means 26 are readily rotatable relative to the first hollow annular member 4. Threads 34 are provided on the inner surface 30 for securing the F-fitting connector 2 to another electrical connection. A flange 36 projects radially outwardly from the ring shaped body 28 and is provided with a plurality of flat surfaces 38 for facilitating rotation of the fastening means 26.

A movable sealing material 40 is inserted into the hollow annular space 20 in an even distribution so as to form a continuous annular layer of the movable sealing material at a desired location as explained below. In the illustration of FIG. 1, the movable sealing material is in contact with both the generally cylindrical outer surface 12 and the generally cylindrical inner surface 18. However, less of the movable sealing material may be inserted into the hollow annular space with no contact or only partial contact between the movable sealing material 40 and the generally cylindrical outer surface 12 or the generally cylindrical inner surface 18. As explained below, it is only necessary to have the movable sealing material evenly distributed so as to form a continuous annular layer of sealing material when displaced. A glob 42 of movable sealing material is attached to the surface portions of the first hollow annular member 4 surrounding the end opening 10. The glob 42 of the movable sealing material clings to the surface portions and completely covers the end opening 10. The movable sealing material comprises any sealant, mastic, gel, resin, adhesive or other similar sealing materials that can be moved but will not readily separate. The movable sealing material 40 and the glob 42 can either be of the same or different sealing materials. A suitable type of sealing material is a silica dielectric sealant marketed under the trade designation GEL TEK.

A conventional electrical cable 44 is provided and comprises an electrically conducting center conductor 46, a first layer 48 comprising a dielectric, a second layer 50 comprising an electrically conducting sheath, a third layer 52 comprising a braid and a fourth layer 54 comprising a jacket.

As illustrated in FIG. 1, a portion of the first layer 48, a portion of the second layer 50, a portion of the third layer 52 and a portion of the fourth layer 54 have been removed to leave a bare center conductor 46. An additional portion of the fourth layer 54 has been removed leaving an exposed portion of the outer surface of the second layer 50, an exposed annular end portion 51 of the second layer 50, an exposed annular end portion 56 of the first layer 48, exposed braids of the third layer 52 and an exposed annular end portion 58 of the fourth layer 54. It is desirable to provide protection for the exposed portions of the first, second and third layers 48, 50 and 52 from detrimental components, such as liquids and gases.

The assembled condition of the components of FIG. 1 is illustrated in FIG. 2. The bared center conductor 46, the first layer 48 and the second layer 50 are inserted through end opening 8 of the first hollow annular member 4. The electrical cable 44 is continued to be moved and the tip 60 of the first hollow annular member 4 moves between the second layer 50 and the third layer 52. The third and fourth layers 52 and 54 move over the generally cylindrical outer surface 12 until the exposed annular end portion 58 and the braids of the third layer 52 contact the movable sealing material 40. Continued movement of the electrical cable 44 forces the movable sealing material 40 back against the closed end portion 22 of the annular space 20 and then back over the outer surface 62 of the fourth layer 54. Sufficient quantities of the movable sealing material 40 are inserted into the annular space 20 so that when the assembled condition of FIG. 2 is reached, there is a continuous annular layer 64 of the movable sealing material 40 in the hollow annular space 20 between the outer surface 62 of the fourth layer 54 and the generally cylindrical inner surface 18 of the second hollow annular member 16. As illustrated in FIG. 2, the continuous annular layer 62 is in contact with the outer surface 62 of the fourth layer 54 and the generally cylindrical inner surface 18 of the second hollow annular member 16 to protect the exposed second layer 50 and the exposed braids 52 from detrimental components by preventing the entry of detrimental components. If desired, a plurality of spaced apart barbs 66 may be provided on the outer surface 12 to assist in preventing removal of the electrical cable 44 from the annular space 20. Also, a plurality of spaced apart ribs 68, for strength and/or ease of crimping, may be provided on the second hollow annular member 16.

During the movement of the electrical cable 44, the bared center conductor 46 pushes through the glob 42 of the movable sealing material but the glob 42 remains clinging to the surface portions of the first hollow annular member 4 surrounding the end opening 10. The exposed annular surface 56 of the first layer 48 and the exposed annular end portion 51 of the second layer 50 move into contact with the glob 42 of the movable sealing material to protect the exposed annular end portions from detrimental components and to prevent detrimental components from entering the electrical cable and connector.

While the invention has been described in relation to the specific electrical cable and F-connector illustrated in the drawing, it is to be understood that the invention is applicable to all types of electrical cable having a center conductor surrounded by one or more layers of different kinds of material and to all types of electrical connectors. The invention provides a seal for the exposed portions of the one or more layers of an electrical cable after portions thereof have been removed to provide a center conductor having a bared end portion with the electrical cable being mounted in an electrical connector so as to protect the exposed portions from detrimental components, such as liquids and gases. When the above described electrical connector is mated with another electrical connector, the bared end portion of the center conductor is also protected from detrimental components, such as liquids and gases.

Another embodiment of the invention is illustrated in FIG. 4. This embodiment is similar to the embodiment of FIGS. 1 and 2 except that the portion of the first hollow annular member 4 that moves between the second layer 50 and the third layer 52 has been removed. In the resulting structure, the new end opening 70 of the first hollow annular member 4 is relatively large and the end opening 10 is relatively small. All of the other parts have been given the same reference numbers. In operation, the bared center conductor 46 and the first and second layers 48 and 50 are inserted into inner surface 6 and moved toward the end opening 10. The third and fourth layers 52 and 54 move into contact with the movable sealing material 40. As the movement of the electrical cable 44 is continued, the third and fourth layers 52 and 54 contact the portion 22 and the movement is stopped. During the movement of the electrical cable 44, the movable sealing material 40 moves back over the outer surface 62 of the fourth layer 54. As described above, a continuous annular layer 64 of the movable sealing material 40 is formed in the annular space between the outer surface 62 of the fourth layer 54 and the generally cylindrical surface 18. The continuous annular layer 64 is in contact with the outer surface 62 and the generally cylindrical inner surface 18 to protect the exposed second layer 50 and the exposed braids 52 from detrimental components by preventing the entry of detrimental components therebetween.

As described above, the bared end portion of the center conductor 46 pushes through the glob 42 of the movable sealing material but the glob 42 remains clinging to the surface portions surrounding the end opening 10. The exposed annular surface 56 and the exposed annular end portion 51 of the second layer 50 move into contact with the glob 42 of the movable sealing material to form a continuous seal between the bared end portion of the center conductor 46 and the portions of the hollow annular member 4 surrounding the end opening 10. If the quantity of the movable sealing material 40 is sufficiently great, a continuous glob of it would be against the portion 22. In that event, some of the movable sealing material would be pushed into the generally cylindrical inner surface 6 by the first and second layers 48 and 50.

It is contemplated that the inventive concepts herein described may be variously otherwise embodied and it is intended that the appended claims be construed to include alternative embodiments of the invention except insofar as limited by the prior art.

What is claimed is:

1. A method for protecting exposed portions of an electrical cable surrounding a center conductor when said electrical cable is secured to an electrical connector comprising:

providing an electrical connector comprising a hollow annular member having at least a first generally cylindrical inner surface having at least one open end and having a relatively small diameter and a second generally cylindrical inner surface having at least one open end and having a relatively large diameter;

inserting a quantity of a movable sealing material into said hollow annular member;

providing an electrical cable having a center conductor having at least one surrounding layer of material and having an outer surrounding layer having an outer surface;

removing a portion of said at least one surrounding layer of material and said outer surrounding layer to provide a bared end portion on said center conductor and an exposed portion on said at least one surrounding layer of material;

inserting said electrical cable into said hollow annular member through said at least one open end of said second generally cylindrical inner surface;

passing at least said bared end portion through said at least one open end of said first generally cylindrical inner surface;

displacing portions of said movable sealing material by the continued insertion of said electrical cable to form at least a continuous ring of said movable sealing material between and in sealing engagement with annular portions of said outer surface of said outer surrounding layer and said second generally cylindrical inner surface.

2. A method as in claim 1 and further comprising:

displacing portions of said movable sealing means to form a continuous seal between said bared end portion and said first generally cylindrical inner surface.

3. A method as in claim 1 and further comprising:

attaching a continuous glob of said movable sealing material to said first generally cylindrical inner surface to close said at lesat one open end thereof; and passing at least said bared end portion through said glob of said movable sealing material so that a continuous seal exists between said bared end portion and said first generally cylindrical inner surface to prevent detrimental components from contacting said exposed portion of said at least one surrounding layer of material.

4. A method as in claim 3 wherein said movable sealing material comprises:

a silica dielectric sealant.

5. A method as in claim 3 wherein:

said electrical connector comprises an F-fitting connector comprising an axial extension of said first generally cylindrical inner surface to form a hollow annular space between said axial extension and said second generally cylindrical inner surface and connecting means for connecting said F-fitting connector to another electrical connector;

inserting movable sealing material into said hollow annular space;

said electrical cable comprises a first annular layer surrounding and in contact with said center conductor, an electrically conducting second annular layer surrounding and in contact with said first annular layer and a third annular layer surrounding and in contact with said second annular layer and a fourth annular layer surrounding and in contact with said third annular layer and wherein said center conductor projects outwardly from said first annular layer so that said first annular layer has an exposed annular end portion, and said second annular layer projects outwardly from said third annular layer so that said second annular layer has an exposed outer surface and an exposed annular end portion and said third annular layer projects outwardly from said fourth annular layer so that portions of said third annular layer are exposed;

inserting said electrical cable into said F-fitting connector through said at least one open end of said second generally cylindrical inner surface until portions of said third and fourth annular layers have moved into said hollow annular space and into contact with said movable sealing material; and displacing said movable sealing material by the continued insertion of said third and fourth annular layers into said hollow annular space to form at least a continuous ring of said movable sealing material between and in sealing engagement with portions of said outer surface of said fourth annular layer and said second generally cylindrical inner surface to protect said exposed portions of said third layer by preventing entry of detrimental components into the electrical connector and into contact with exposed portions of said first, second and third annular layers.

6. A system for protecting exposed portions of an electrical cable surrounding a center conductor when said electrical cable is secured to an electrical connector comprising:

an electrical connector comprising a hollow annular member having at least a first generally cylindrical inner surface having at least one open end and having a relatively small diameter and a second generally cylindrical inner surface having at least one open end and having a relatively large diameter;

an electrical cable having a center conductor, at least one layer of material surrounding said center conductor and an outer layer having an outer surface;

a bared end portion of said center conductor projecting outwardly from said at least one layer and said outer layer;

portions of said electrical cable being located in said hollow annular member with said bared end portion extending through and projecting outwardly from said open end of said first generally cylindrical inner surface;

a continuous ring of a movable sealing material between and in sealing engagement with annular portions of said outer surface of said outer layer and said second generally cylindrical inner surface wherein said continuous ring of movable sealing material is formed by inserting a quantity of said movable sealing material into said hollow annular member and inserting said electrical cable into said hollow annular member through said at least one open end of said second generally cylindrical inner surface and passing said bared end portion through said at least one open end of said first generally cylindrical inner surface; and a continuous ring of said movable sealing material between and in sealing engagement with an annular portion of said bared end portion and an annular portion of said first generally cylindrical inner surface.

7. A system as in claim 6 and further comprising:

a glob of said movable sealing material attached to said first generally cylindrical inner surface to close said at least one open end thereof with said bared end portion passing through said glob to form a continuous ring of said movable sealing material between and in sealing engagement with an annular portion of said bared end portion and an annular portion of said first generally cylindrical inner surface.

8. A system as in claim 7 wherein said movable sealing material comprises:

a silica dielectric sealant.

9. A system for protecting exposed portions of an electrical cable surrounding a center conductor when said electrical cable is secured to an electrical connector comprising:

an F-fitting connector comprising a first hollow annular member having a generally cylindrical inner surface having an outer open end and an inner open end and having a relatively small diameter said first hollow annular member having a generally cylindrical outer surface and a flange portion projecting outwardly therefrom, a second hollow annular member projecting axially from said flange portion and concentric to said first hollow annular member, said second annular hollow member having a generally cylindrical inner surface spaced from said generally cylindrical outer surface of said first hollow annular member so as to form a hollow annular space therebetween having a closed end and an open end and having a diameter greater than said relatively small diameter, and connecting means for connecting said F-fitting connector to another electrical connector;

an electrical cable having a center conductor having a bared end portion and a plurality of layers of material surrounding the remaining portions of said center conductor;

said electrical cable having an outer layer having an outer surface;

said plurality of layers of material having exposed portions;

portions of said center conductor and at least one of said plurality of layers of material being located in said first hollow annular member with said bared end portion extending through and projecting outwardly from said outer open end of said first hollow member;

at least one of the remaining layers of material and said outer layer being located in said hollow annular space;

a continuous ring of a movable sealing material between and in sealing engagement with annular portions of said outer surface of said outer layer and said generally cylindrical inner surface of said second annular hollow member wherein said continuous ring of movable sealing material is formed by inserting a quantity of movable sealing material into said hollow annular space and displacing said quantity of movable sealing material as said at least one of the remaining layers and said outer layer are inserted into said hollow annular space; and a glob of said movable sealing material attached to said generally cylindrical inner surface of said first hollow portion to close said outer open end thereof with said bared end portion passing through said glob to form a continuous ring of said movable sealing material between and in sealing engagement with an annular portion of said bared end portion and an annular portion of said generally cylindrical inner surface of said first hollow member.

10. A system as in claim 9 wherein said movable sealing material comprises:

a silica dielectric sealant.

* * * * *